United States Patent [19]

Grover

[11] 3,988,021

[45] Oct. 26, 1976

[54] GAME TABLE

[76] Inventor: Douglas B. Grover, 201 S. Greenfield, Space 79, Mesa, Ariz. 85206

[22] Filed: Oct. 30, 1975

[21] Appl. No.: 627,249

[52] U.S. Cl. ..... 273/3 C; 108/1; 108/10

[51] Int. Cl.[2] ..... A63D 15/00

[58] Field of Search ..... 273/5 R, 5 A, 5 B, 2, 273/3 R, 3 A, 3 C; 108/1, 6, 137, 144, 141, 142, 10, 12, 138, 111

[56] References Cited

UNITED STATES PATENTS

| | | | |
|---|---|---|---|
| 122,830 | 1/1872 | Heyl | 273/5 R |
| 1,273,237 | 7/1918 | Lee | 273/5 R |
| 1,840,203 | 1/1932 | Kimball | 108/1 |
| 2,424,060 | 7/1947 | Shapiro | 108/1 X |
| 3,744,812 | 7/1973 | Langhausen | 273/3 C |

*Primary Examiner*—Richard C. Pinkham
*Assistant Examiner*—T. Brown
*Attorney, Agent, or Firm*—Drummond, Nelson & Ptak

[57] ABSTRACT

A game table is disclosed having a support structure including leg assemblies at either end supporting the table. The leg assemblies include a first member pivotally attached to the table along the longitudinal axis of the table and a second member pivotally attached to the first and to a caster pedestal. The pedestals are interconnected by an adjustable rod which can be extended and retracted to level, raise and lower the table. Adjustable braces extend between the tabletop and the pedestals. The tabletop can be pivoted to a generally vertical position thereby facilitating movement and storage of the table when not in use.

7 Claims, 11 Drawing Figures

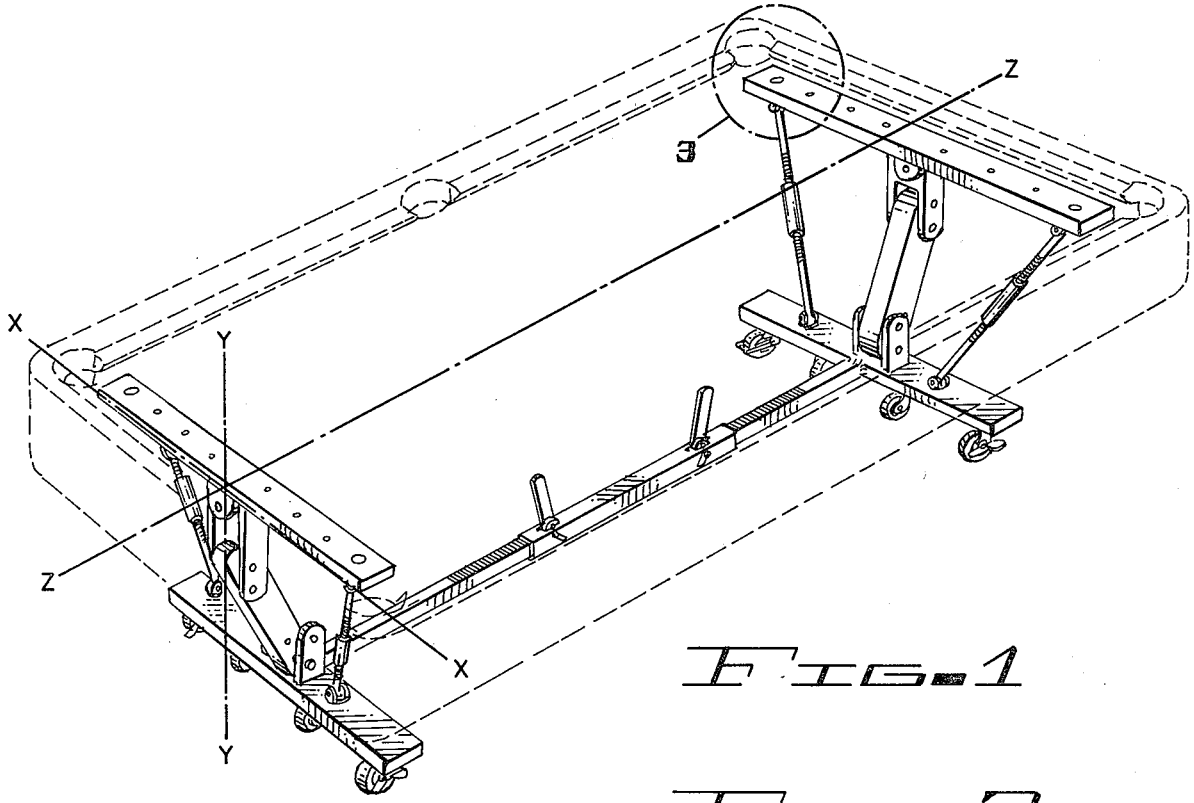
FIG-1
FIG-2
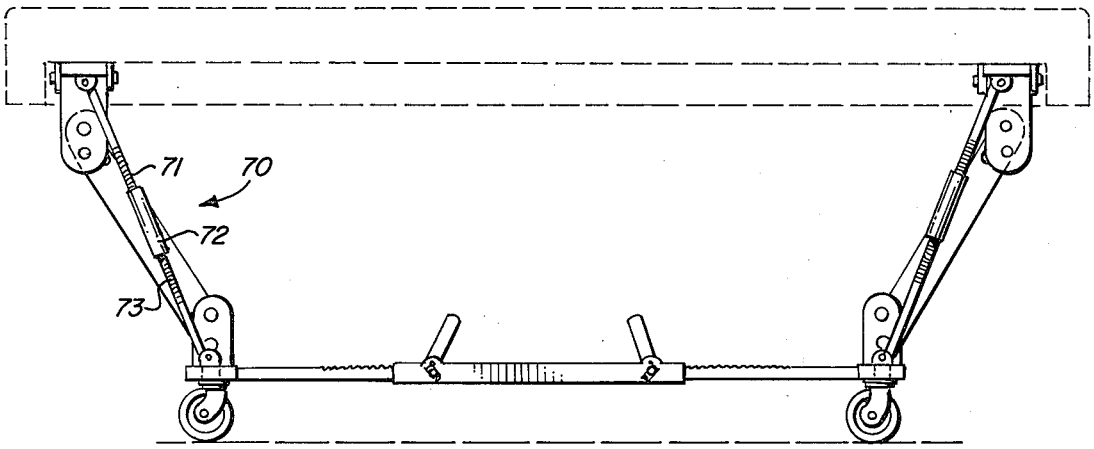
FIG-4
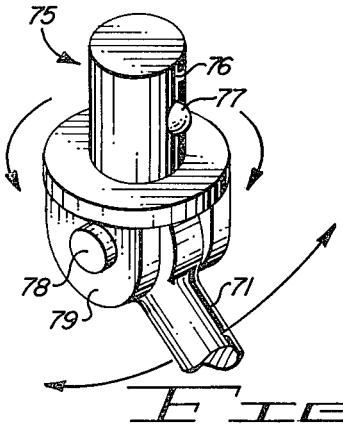
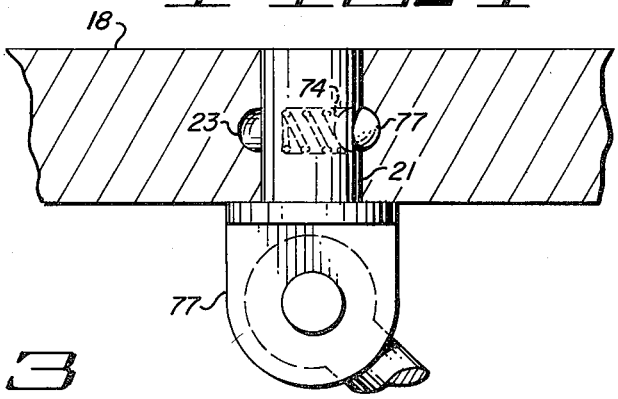
FIG-3

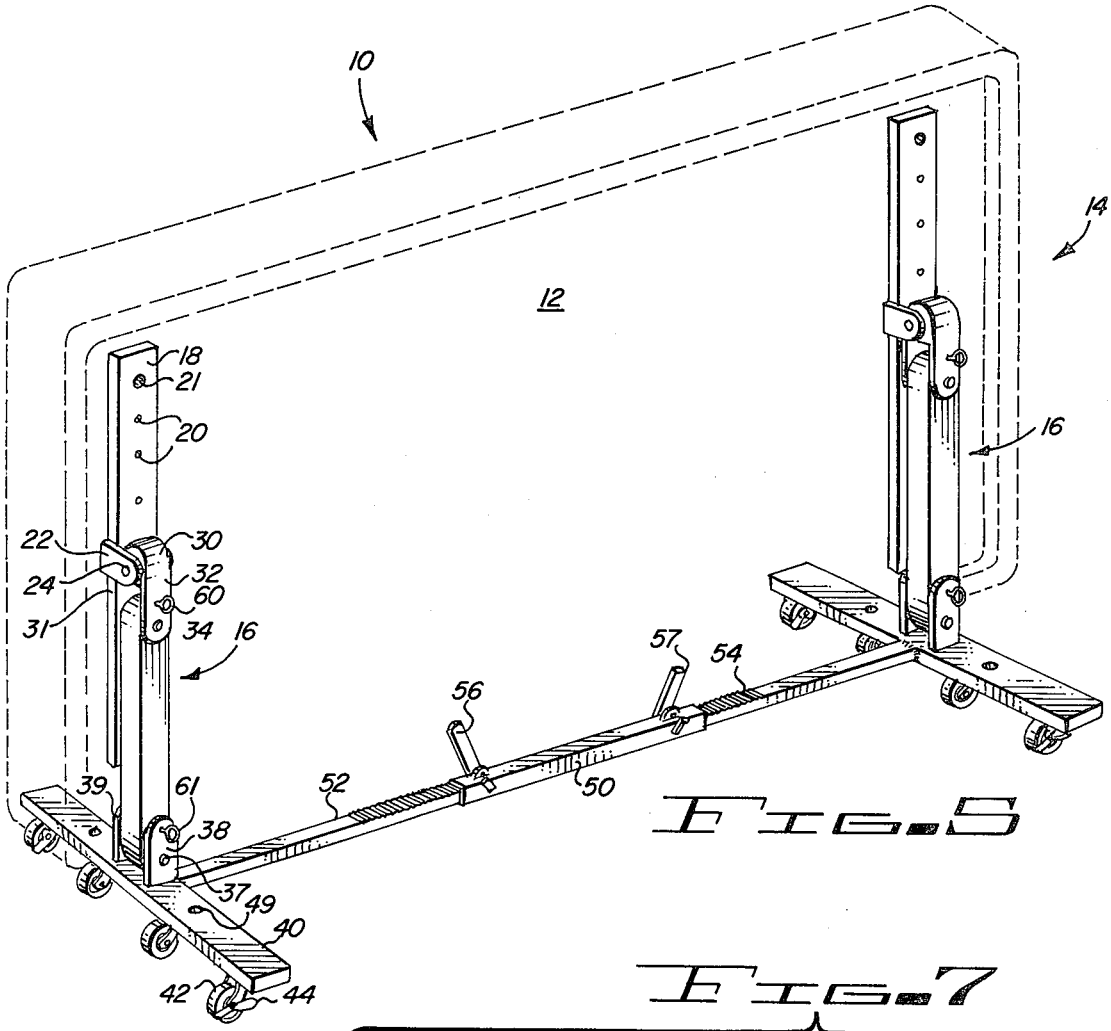
FIG. 5
FIG. 7
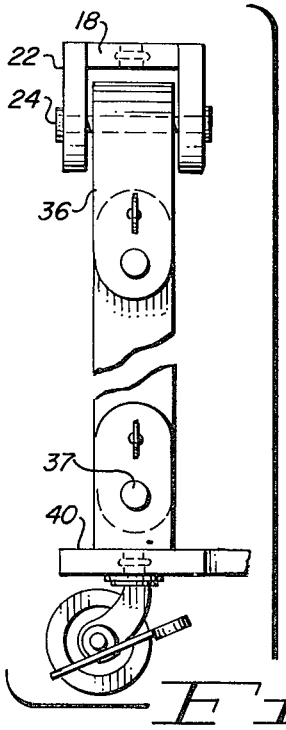
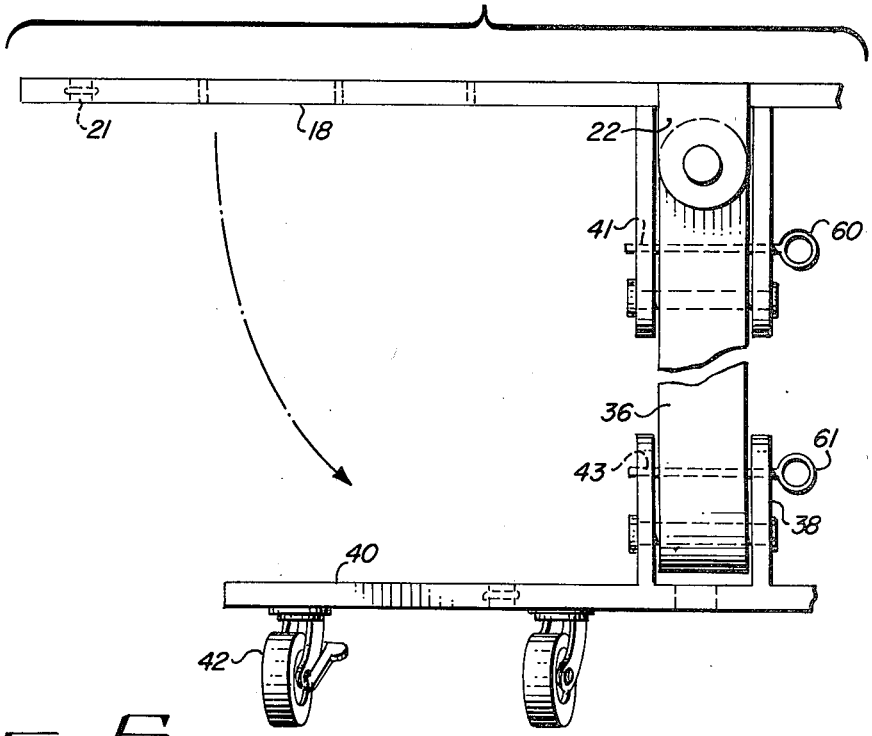
FIG. 6

GAME TABLE

This invention relates to a game table and more particularly relates to a game table having an adjustable base structure for adjusting the tabletop in a horizontal position and for pivoting the tabletop to a vertical position permitting the table to be stored out of the way when not in use.

Many recreational games are placed upon a surface which is formed as a top of a table surface. Typical of these games are pool, billiards, Ping Pong, various dice and other games. Many of these table surfaces are large and bulky and occupy a substantial horizontal area. Therefore, when the table is not being used, the tables often occupy space which could otherwise be used. However, because of the bulk and often extreme weight of tables of this type, it is not convenient to manually lift the tables from one location to another. Even if a table of this type is moved against a wall of a room when not in use, it nevertheless occupies a substantial area. For example, a conventional standard-sized pool table measures approximately 98 by 96 inches and often weighs in excess of 500 pounds.

Various table supporting structures adapted to permit the table to be folded to a stored position are known in the prior art. For example, there are supports for Ping Pong tables in which the table is foldable along a transverse center line so that the table may be stored. This arrangement is suitable for lighter weight playing tables but has obvious disadvantages when applied to game tables such as billiard or pool tables. Further, such arrangement results in a joint or fold line interfering with the top surface or bed of the table.

U.S. Pat. No. 3,585,945 discloses a pool table which is provided with a pair of leg structures pivotal between erect and collapsed positions. A mobile support structure is provided which includes a pair of wheel supporting members each having wheels and connected to the frame of the pool table for movement between operative and inoperative positions. The wheel mounting members, when in the operative position, foldably support the table after the table has been turned upon one longitudinal edge permitting movement of the table. The pool table support described in this patent represents an advance in the state of the art but requires the use of separate leg structures apart from those used to support the table in a normal playing position. Further, the user must tilt the table up on its side to a vertical position so that the table is supported on the casters when it is desired to move or store the table.

Briefly, in summary the present invention provides a mobile table support structure including a leg assembly positioned near either end of the underside of the table. The leg assembly includes a link which has one end pivotally attached to the table so that the table may be pivoted along the longitudinal center line of the table. The other end of the link is pivotally connected to an angularly adjustable leg member. The lower end of the leg member is pivotally connected to a caster support on which caster wheels are mounted so that the table may be moved about. The leg assemblies at either end of the table are interconnected by an adjusting rod which may be extended or retracted by a suitable manual or power operated mechanism such as a ratchet assembly. Extending or retracting the rod will longitudinally move the caster supports and accordingly raise or lower the table as desired. The table can be raised to a suitable height to provide clearance permitting the table about its longitudinal axis to a vertical position for storage. It is generally necessary to raise the top in order to store it since the height of the playing surface from the floor often is less or does not substantially exceed one-half of the transverse table dimension or width so that merely providing pivots about the longitudinal center line will not permit the table to be swung to a vertical position for storage. The support structure of the present invention also permits the tabletop to be adjusted and levelled in a playing position to accommodate irregularities in the floor upon which the table is supported.

The above and other objects and advantages of the present invention will become more apparent from the following specification, claims and drawings in which:

FIG. 1 is a perspective view of the table of the present invention with the tabletop shown in phantom lines;

FIG. 2 is a side elevational view of the table of the present invention;

FIG. 3 is a perspective view of an end portion of the brace assembly as shown in FIG. 1;

FIG. 4 is a detail view illustrating the end of the brace structure in an engaged position;

FIG. 5 is a perspective view illustrating the table of the present invention in a vertical stored position;

FIG. 6 is a side elevational view of one leg assembly;

FIG. 7 is an end view of one leg of the support structure;

Figure 8:
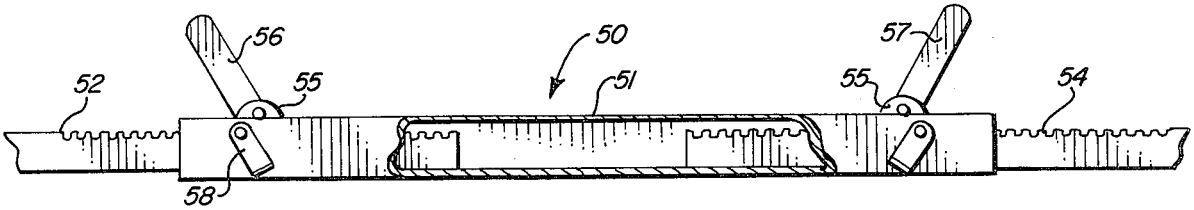
FIG. 8 is a detail view of a portion of the adjusting rod.
Figure 9:
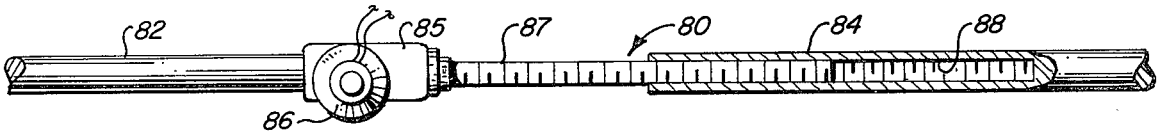
FIG. 9 is a view illustrating another form of the adjusting rod.

Referring now to the drawings, and more specifically to FIGS. 1, 2 and 5, the game table of the present invention is shown and is generally designated by the numeral 10. For purposes of illustration the game table 10 is shown as a pool table. However, it will be appreciated that the table 10 could be any of a number of types of tables. In FIG. 1 axes, X, Y and Z have been superimposed for orientation and to facilitate explanation of operation of the invention.

Table 10 has a generally rectangular top 12 defining an appropriate playing surface defining conventional pockets. These elements have been shown in phantom since they are well known and do not comprise a part of the invention. The underside of top 12 is carried on a support 14 having leg assemblies 16 mounted near opposite ends of the table. The leg assemblies 16 are substantially identical and a detail description of one of the leg assemblies 16 will apply equally to both. Each of the leg assemblies includes a cross support member 18 which is secured to the underside of the table by appropriate screws or bolts 20. A clevis or hinge 22 is secured to the cross member 18 of the table so that the tabletop 12 can be rotated about the longitudinal Z—Z axis at pivot shafts 24. A vertical link member 30 is pivotally attached at 24 to hinge 22. Link 30 is comprised of two opposite side plates 31 and 32 between which extends pivot shaft 34. Elongate leg member 36 is pivotally attached to the shaft 34. The lower end of leg 36 is pivotally attached to transverse pedestal 40 at a clevis defined by plates 38 and 39 projecting from the caster support 40. A pivot shaft 37 projects between plates 38 and 39 through an appropriate bore in leg 36. A plurality of conventional casters 42 which may be locked or unlocked at lever 44 are mounted in pedestal 40. The various pivots are shown as journals but can include appropriate rollers or other bearings to reduce friction.

Leg 36 can be rigidly secured to line 30 and clevis 38 by locking means 60 and 61 in the form of pins removably engageable in respective apertures 41 and 43 provided in bar 36. Tabletop 12 is stabilized in a horizontal position by means of diagonal struts or braces 70 which are removably engageable in hole 21 provided in cross support 18 and hole 49 provided in caster support 40. The details of the braces 70 are best seen in FIGS. 1 to 4. Each of the braces includes rod members 71 and 73 oppositely extending from and in threaded engagement with sleeve 72. Sleeve 72 is interiorly threaded. The ends of rods 71 and 73 which are engaged in sleeve 72 are oppositely threaded so that when sleeve 72 is manually turned, rods 71 and 73 both extend or retract with reference to sleeve 72. The outer ends of rods 71 and 73 each carry a universal joint 75. Joint 75 includes a pivot assembly 79 which is attached to the upper end of the rods at pin 78. A stub shaft 76 projects from the pivot and is of a length and diameter to be snugly received within the appropriate holes 21 and 49 located in cross member 20 and pedestal 40. A retainer 77 in the form of a ball bearing partially projects through an aperture provided in sub-shaft 76. Retainer 77 is spring biased by spring 74 as is best shown in FIG. 4.

An annular groove 23 is provided in each of the holes 21 and 49 to receive retaining member 77. It will be apparent that the brace 70 can be secured in place in a diagonal position extending between the casters 40 on the underside of the table by engaging universal joint 75 at opposite ends of the rod 70 in the apertures 21 and 49. This can be done by simply "snapping" the stud shaft in place in the holes with retainer 77 engaging the annular groove within the hole. Rotation of sleeve 72 will shorten or lengthen the brace to horizontally level the table along the X—X axis.

Raising and lowering the table or levelling longitudinally along the X—X axis is accomplished by extending and retracting the adjusting rod 50. Adjusting rod 50 is shown in detail in FIG. 8 and includes a central ratchet housing assembly 51 which has conventional ratchet mechanisms 55 located near either end. Each of the mechanisms 55 is reversible by means of a lever 58. Handles 56 and 57 enable the ratchet mechanisms to be manually operated. Extensible and retractable members 52 and 54 are operable by means of the ratchet mechanisms. Member 52 is connected to the pedestal 40 at the left end of the table as viewed in FIG. 2. Similarly, member 54 is connected to the caster support 40 at the right end of the table. The ratchet mechanisms need not be described in detail as they are conventional and well known.

Extension and retraction of members 52 and 54 by means of ratchet mechanisms 55 will longitudinally move the pedestal at either end of the table. This will, in turn, raise and lower the table with the pedestal being movable from the position shown in FIG. 5 with the leg 36 in a generally vertical position to the position shown in FIG. 2 with the leg 36 forming an obtuse angle with the longitudinal rod 50. The caster supports 40 at either end of the table are preferably independently movable so that the table can be levelled longitudinally to accommodate variations in the floor upon which the table is supported. It is also preferred that the rods 52 and 54 be provided with stops so that they cannot be extended beyond the position at which legs 36 are in substantially vertical position.

FIG. 5 illustrates another form of the adjusting rod. In this embodiment the adjusting rod is generally designated by the numeral 80 having rod members 82 and 84 connected to the pedestals at either end of the table. A gear motor 85 driven by electric motor 86 is carried on shaft 82. The output shaft of gear box 85 carries a threaded shaft 87 which is in threaded engagement with the internal threads 88 carried in rod 84. Electric motor 86 is reversible by conventional motor controls, not shown. Thus adjusting rod 80 can be effectively extended or retracted by selectively operating electric motor 86. This embodiment eliminates the manually operated ratchet mechanisms shown in the preceding figure. It will be obvious that the adjusting rod can be also pneumatically or hydraulically extensible.

Figure 10:
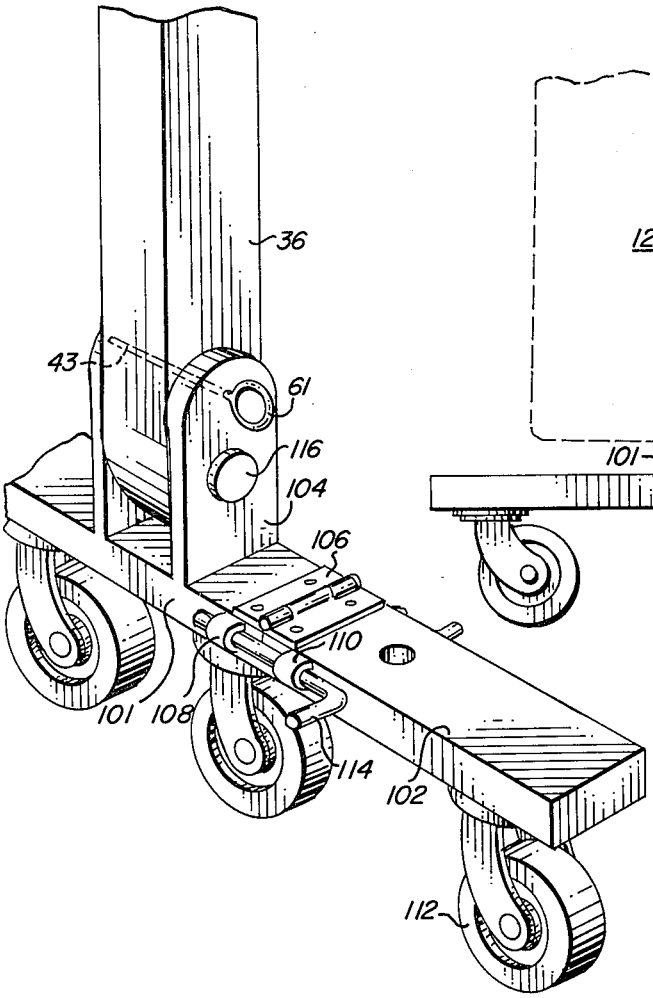
FIG. 10 is a perspective view illustrating a portion of the leg assembly.
Figure 11:
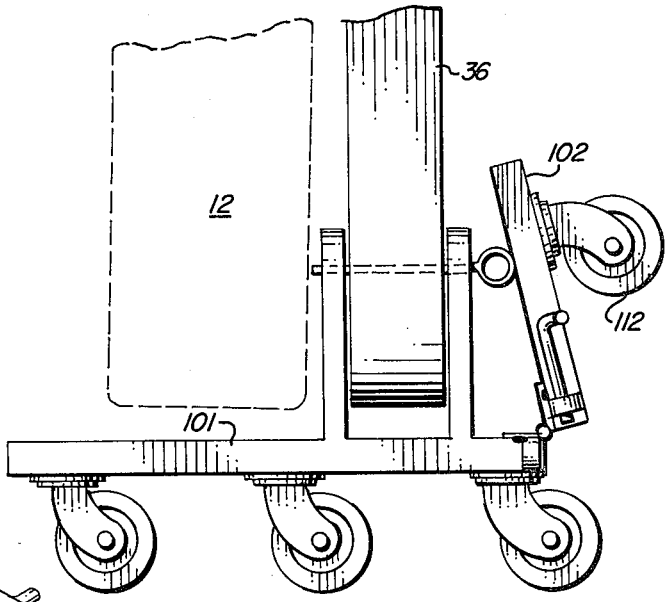
FIG. 11 is a view illustrating the caster support assembly in a folded position.

FIGS. 10 and 11 show a modified form of the pedestal which enables the table to be stored in a position occupying a minimum of space. One of the transversely extending leg members 102 of each pedestal 100 are attached by means of hinge 106 to the body 101 of the pedestal. As has been described above, the pedestal carries clevis assembly 104 which pivotally secures bar 36 at pivot 116. A latch member 108 is secured to the opposite lateral sides of support 101 adjacent the hinge. Similarly, latch members 110 are secured on leg member 102 adjacent the hinge. Bolts 114 may be selectively engaged in latch members 108 at opposite sides of member 100 to form a rigid structure. Normally, when the table is in use bolts 114 will be in the engaged position shown in FIG. 10. When the table is in a stored position, as for example placed in an out of the way position against the wall, bolts 114 will be disengaged from latches 108. This will allow leg 102 to be swung upwardly to the position shown in FIG. 11. Therefore, the support occupies less horizontal space in the stored position. When the table is used, leg 102 is swung downwardly and bolts 114 engage to form a rigid support for the table. It may be desirable to pivot the legs 102 horizontally out of the way instead of vertically as shown. In this instance, the position of the hinge and latch members will be interchanged.

During use of the game table, the table 10 will be substantially in the erect position shown in FIGS. 1 and 2. Stabilizer or braces 70 will be positioned extending between the transverse support 18 on the underside of the table and the pedestals 40. In the event the floor supporting the table is uneven, the table surface 12 can be easily levelled. Levelling along the Z—Z axis is accomplished by turning sleeves 72 in the appropriate direction to extend or retract the stabilizer braces 70 thereby tilting the tabletop with respect to longitudinal axis of the table. The table can also be levelled in the X—X plane by appropriately extending or retracting the adjusting rods 52 and 54. In the erect position, the table is rigidly supported and the casters 42 are preferably locked at braking devices 44.

When it is desired to place the table in an inoperative or a stored position, the adjusting rod 50 is extended until the bars or columns 36 are in a generally vertical position. Extension of members 52 and 54 of the adjusting rod will move the pedestals at opposite ends of the table longitudinally outwardly. This movement will cause the height of the tabletop to increase. This procedure is generally necessary because the normal playing height of the table is not sufficient to permit the table to be pivoted about the longitudinal axis without interfering with either the floor or the pedestal supports 40. When the table has been raised to the proper position and the braces 70 removed, the tabletop can be pivoted to a vertical position resting along the columns 36 as seen in FIG. 5. Note that the braces 70 can easily be disengaged from the underside of the table and the caster supports by merely applying vertical separating force. This will cause the locking or retaining ball 77 to be depressed inwardly permitting the sub-shaft 76 to disengage from its respective hole. Tabletop 12 is pivoted to a vertical position about pivot 24. Locking pins 60 and 61 are inserted through holes 41 and 43, respectively, in bar 36 to maintain the support rigid.

After the table has been pivoted to the vertical inoperative position, the user may easily and conveniently move the table from one location to another location for storage. This can be accomplished by simply releasing the caster lock at lever 44 making the table mobile on the casters. With the tabletop pivoted in a vertical position, the entire unit occupies less horizontal space so the table can be rolled against the wall to an out of the way position. Once the table is placed in a stored position, the bolts 114 can be disengaged from latch members 108 permitting legs 102 to be swung upwardly as shown in FIG. 11. This further reduces the horizontal space occupied by the unit in a stored position.

To place the table in play the reverse procedure is practiced. Caster support leg 102 is rotated to a horizontal position and bolts 114 appropriately engaged in latches 108. The table is rolled on the casters to the desired location and locking pins 60 and 61 are removed. The tabletop 12 is pivoted about pivot 24 to a generally horizontal position. Adjusting bar 50 is retracted by means of handles 56 and 57 until the tabletop is at the desired height. Braces 70 are then appropriately inserted between the caster supporting the underside of the table. Minor adjustments to level the table as described above can then be made. In some instances, it may be desirable to provide additional braces 70. For example, large tables may require braces 70 located at the longitudinal mid-point of the table. An appropriate adaptor can be secured to the bar or rod 50 to receive the lower ends of the brace.

From the foregoing it will be seen that the present invention provides a game table support which permits the table to be folded in a convenient position for storage. The table support is mobile and also permits the table to be quickly erected and adjusted to a level horizontal position. The present invention is sturdy, simple and can be easily fabricated and is extremely convenient to use. As pointed out above, the support of the present invention can be used in connection with game tables of various types.

It will be understood that various changes can be made in the form details and arrangements and proportions of the various parts without departing from the spirit and scope of the present invention.

I claim:

1. A game table comprising:

a. a substantially planar top having longitudinally opposed ends and a transversely spaced apart sides;

b. a support structure, said structure including first and second leg assemblies disposed adjacent opposite ends of the table, each of said leg assemblies including:

i. a first member pivotally secured to the underside of said top along a longitudinally extending pivot axis, whereby said table can be selectively pivoted between a substantially vertical and a substantially horizontal position;

ii. a second member pivotally secured to said first member along a generally transverse pivot axis;

iii. pedestal means pivotally secured to said second member along a generally transverse pivot axis; and c. adjusting means for selectively moving said pedestal means longitudinally bidirectionally thereby selectively raising and lowering said table top.

2. The game table of claim 1 wherein said adjusting means comprises rod means interconnecting said leg assemblies and including ratchet means for selectively extending and retracting said rod means and said pedestal means.

3. The game table of claim 1 further including braces detachably secured between said support structure and said table top being extensible and retractable to level stabilize the table top.

4. The game table of claim 1 wherein said pedestal includes a foot member extending transversely from said second member, at least a distal portion of said foot members being hingedly affixed whereby it can be pivoted to an out-of-the-way position.

5. The game table of claim 1 wherein said pedestal means include caster means.

6. The game table of claim 1 wherein said adjusting means comprises rod means interconnecting said leg assemblies and including power actuable means for selectively extending or retracting said rod means and said pedestal means.

7. The game table of claim 2 further including locking means for locking said leg assemblies in predetermined rigid positions.

* * * * *